United States Patent [19]

Arai

[11] Patent Number: 4,473,221

[45] Date of Patent: Sep. 25, 1984

[54] PAPER FEEDING ROLLER

[75] Inventor: Tomio Arai, Hachioji, Japan

[73] Assignee: Konishiroku Photo Industry Co., Ltd., Tokyo, Japan

[21] Appl. No.: 301,236

[22] Filed: Sep. 11, 1981

[30] Foreign Application Priority Data

Sep. 30, 1980 [JP] Japan ..... 55-138211[U]

[51] Int. Cl.[3] ..... B65H 3/06

[52] U.S. Cl. ..... 271/109; 271/119; 226/190

[58] Field of Search ..... 198/780, 842, 843; 193/37; 29/124; 226/190, 194; 271/109, 119; 474/95, 903

[56] References Cited

U.S. PATENT DOCUMENTS

| | | | |
|---|---|---|---|
| 527,065 | 10/1894 | Ketchum | 474/95 |
| 593,646 | 11/1897 | Donovan | 474/903 |
| 685,370 | 10/1901 | Bridgewater | 271/119 |
| 1,259,616 | 3/1918 | Gilbert | 474/903 |
| 1,496,692 | 6/1924 | Voss | 29/124 |
| 1,758,280 | 5/1930 | Evans | 198/780 |
| 2,860,766 | 11/1958 | Welter | 198/780 |
| 3,158,366 | 11/1964 | Godlewski | 271/119 |
| 3,784,120 | 1/1974 | Harris | 29/124 |
| 4,045,015 | 8/1977 | Sardeua | 271/119 |

FOREIGN PATENT DOCUMENTS

| | | | |
|---|---|---|---|
| 153239 | 11/1920 | United Kingdom | 474/95 |
| 2033876 | 5/1980 | United Kingdom | 271/119 |

*Primary Examiner*—Bruce H. Stoner, Jr.
*Assistant Examiner*—James E. Barlow
*Attorney, Agent, or Firm*—Frishauf, Holtz, Goodman and Woodward

[57] ABSTRACT

A sheet feeding apparatus including a resilient rotatable separator roller which includes a radial cut permitting radial attachment and detachment from a rotatable shaft. A fixing device is provided for fixing the roller to the shaft.

4 Claims, 8 Drawing Figures

PAPER FEEDING ROLLER

BACKGROUND OF THE INVENTION

1. Field of the Invention

The present invention relates to the improvement of a paper feeding means in a copying machine or the like.

2. Description of the Prior Art

Conventional paper feeding means of copying machine or the like, generally include a number of notched friction rollers which are attached to a rotatable shaft and which are brought into pressure contact with the upper surface of a pile of papers for forwarding with the upper-most positioned paper. In order to replace such a notched friction roller when it is abraded it is necessary to detach the bearing of the rotatable shaft.

SUMMARY OF THE INVENTION

The present invention relates to in a paper feeding means comprising a rotatable shaft and at least one of notched friction roller being attached to said shaft, being brought into contact at pressure with the upper surface of a pile of paper and forwarding the upper-most positioned paper, which said notched friction roller is attached said rotatable shaft so that said roller can be attached to the detached from the shaft by being moved in the radial direction of the shaft.

DETAILED DESCRIPTION OF THE PREFERRED EMBODIMENTS

Figure 1:
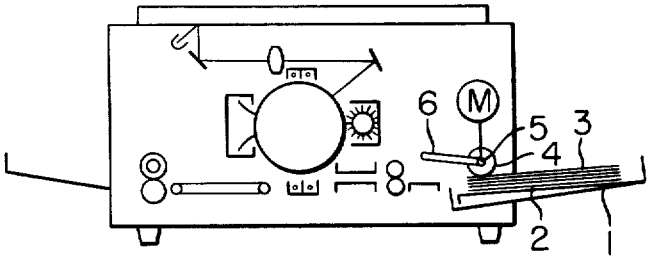
FIG. 1 is a front view of the essential part of an electrophotographic copying machine to which the invention pertains.

In FIG. 1, reference numeral 1 is a paper feeding tray; 2 is a paper loading plate upwardly biased by a spring; 3 is a pile of copy papers placed on the paper loading plate; 4 is a notched friction roller coming into contact at pressure with a pile of papers 3 and forwarding the upper-most positioned paper; 5 is a rotatable shaft equipped with notched friction roller 4; 6 is a swing-arm for making rotatable shaft 5 upward to a position where notched friction roller 4 is not brought into contact at pressure with a pile of papers 3 when the papers are not fed; and M represents a driving source for rotatable shaft 5. In the present invention, notched friction roller 4 is constituted so that it is mounted to rotatable shaft 5 from the radial direction thereof, and is also attachable to and detachable from said rotatable shaft without detaching said shaft 5.

Figure 2:
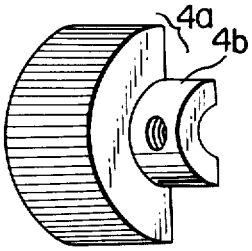
FIG. 2 to FIG. 4 are perspective views respectively showing the essential parts of an embodiment of the invention.
Figure 3:
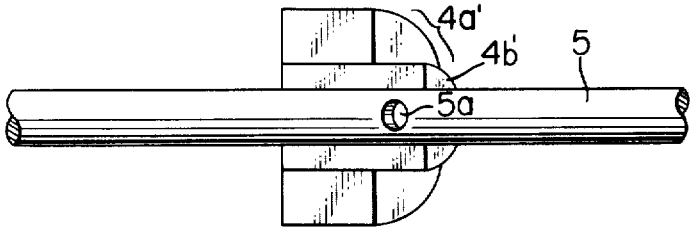
Figure 4:
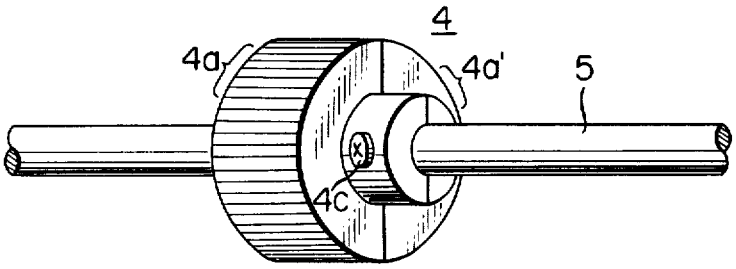

FIG. 2 to FIG. 4 respectively show a notched friction roller 4, of the present invention. The roller 4 is diametrically cut in half to form halves 4*a*, 4*a*', of frictional material such as natural rubber or synthesized rubber surrounding respective a portions of a boss 4*b*, 4*b*'. The boss 4*b*, 4*b*' is made of a rigid material such as metal or hard plastic, and is cut in half on the diametrical surface. Thereof the portions of the bosses 4*b* and 4*b*' protruding from roller portions 4*a* 4*a*' have washer based holes provided therein at the positions corresponding to each other to receive screw 4*c* and an unillustrated nut for uniting the halved roller portions 4*a* and 4*a*' together. On the rotatable shaft 5 to be equipped with said notched friction roller 4, a through hole 5*a* in which screw 4*c* can be screwed is provided at the position where notched friction roller 4 is equipped thereto. The notched friction roller 4 is then fitted to rotatable shaft 5 so that the halves 4*a* and 4*a*' are arranged with said rotatable shaft 5 therebetween them and the washer based holes of bosses 4*b* and 4*b*' coinciding in position with the through hole 5*a* of rotatable shaft 5, and so that screw 4*c* and the nut can be screwed in the washer based holes, and thus the halves can be united in a body around shaft 5. If the joining surfaces of the resilient roller portions 4*a* 4*a*' are cemented by a binding agent, the joined surfaces are not separated from each other at all during use.

Figure 5:
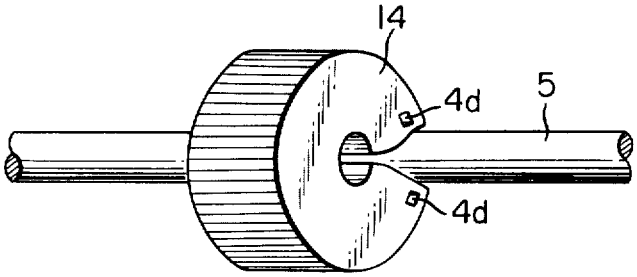
FIG. 5 and FIG. 6 are perspective views respectively showing the essential parts of another embodiment of the invention and FIG. 7 and FIG. 8 are a perspective view and a vertical side sectional view respectively showing a modification of the embodiment shown in FIG. 5 and FIG. 6.
Figure 6:
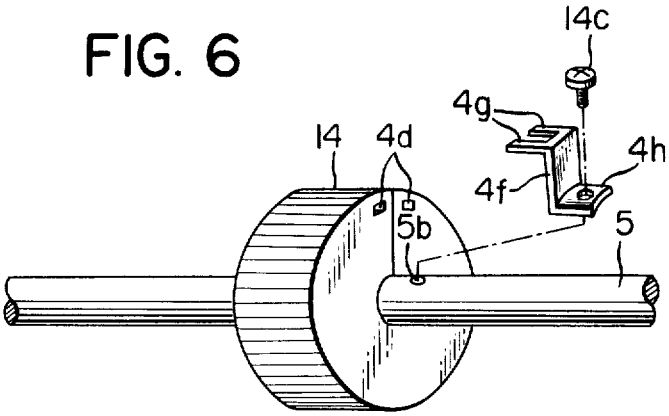
Figure 7:
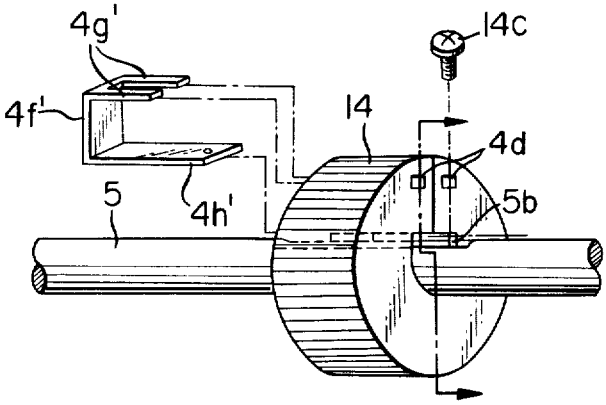
Figure 8:
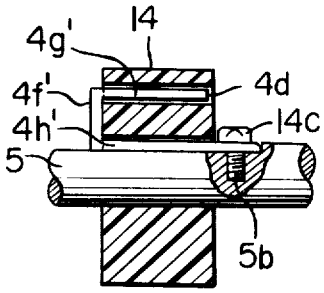

FIG. 5 to FIG. 8 respectively show a notched friction roller 14 made of elastically frictional material which is only partically cut in half on the diametrical surface thereof. In said notched friction roller, 14 rotatable shaft 5 can be fit into the axle hole by broadening the cut surface of said roller 14 as shown in FIG. 5. On the end surface of notched friction roller 14 and on each side of the cut surfaces thereof, hole 4*d* is respectively provided in parallel with the axle, and shaft 5*a* screw hole 5*b* is provided at the position on rotatable shaft 5 where the notched friction roller 14 is to be mounted. Accordingly, fork-shape protrusions 4*g* of shaft fixing member 4*f* which is made of a rigid material, are fitted in respective holes 4*d* of notched friction roller 14 the shaft fixing member 4*f* has fixing portion 4*l* which faces against rotatable shaft 5, and which is fixed to rotatable shaft 5 by screw 14*c*, passing through hole 5*b* and a hole in portion 4*h*. Thus the notched friction roller is mounted to shaft 5. FIG. 6 shows an embodiment, wherein fixing member 4*f* is in the shape of letter z, and is screwed down to rotatable shaft 5 on the side thereof which is inserted into holes 4*d* FIG. 7 and FIG. 8 respectively show another embodiment, wherein the shaft fixing member 4*f*' is forms in the shape of and the shaft fixing member is inserted and the screwing down is made on the opposite side to the inserted side. In the embodiment shown in FIG. 6, there may be a danger of shifting of notched friction roller 14 away from fixing member 4*f*, and to the contrary, in the embodiment shown in FIG. 7 and FIG. 8, there is no danger of shifting of roller 14 because said notched friction roller 14 is prevented from shifting by the head of lock screw 4*c* and by the vertical portion of fixing member 4*f*'. In addition, the protruded portions of and 4*f*' fixing member 4*f* prevent the cut surfaces of notched friction roller 14 from separating and prevents slippage between rotatable shaft 5 and said notched friction roller 14. As described above, according to the present invention, notched friction roller can easily be removed from the rotatable shaft without detaching the rotatable shaft.

What is Claimed is:

1. In a paper feeding means comprising a rotatable shaft and at least one notched friction roller attached to said shaft, the friction roller having an outer surface which is brought into pressure contact with the upper surface of a pile of papers and forwarding the upper-most positioned paper of said pile, the improvement wherein:

said notched friction roller is made of resilient material and has a resilient friction outer surface, and said notched friction roller having a hole therein through which said rotatable shaft extends for attaching said notched friction roller to said rotatable shaft such that said notched friction roller is laterally immovable on said shaft when attached to said shaft, said notched friction roller including means for permitting attachment to and detachment from said rotatable shaft by movement of said notched friction roller in the radial direction of said rotatable shaft, said means for permitting attachment and detachment of said notched friction roller comprising a single cut in the radial direction thereof, said single cut extending from said hole to said outer surface of said notched friction roller, and said single cut extending through said roller in the direction of the axis of said rotatable shaft, and said single radially directed cut having opposed radially directed surfaces which face and normally contact each other so that said roller presents a substantially round outer periphery, said roller being sufficiently resilient and elastically deformable so that said rotatable shaft is passable between said opposed normally contacting surfaces of said single radially directed cut from the outside of said roller to the inside of said hole in said roller by separation of said opposed surfaces due to deformation of said roller during passing of said shaft between said opposed normally contacting surfaces of said single cut, said roller being fixed to said rotatable shaft by fixing means which engage the roller such that rotation of the roller relative to the shaft is prevented.

2. The paper feeding means of claim 1, wherein said notched friction roller is made of an elastically resilient frictional material.

3. The paper feeding means of claim 2, wherein said fixing means comprises:

a shaft fixing member having fork-shaped protrusions and a fixing portion adapted to bear against said rotatable shaft; and a pair of recesses provided on an end surface of said notched friction roller, one recess being provided on each side of said single cut in said notched friction roller, said notched friction roller being mounted to said rotatable shaft so that said fork-shaped protrusions are respectively received in a recess of said notched friction roller and said fixing portion of said fixing member being fixed to said rotatable shaft to prevent rotation of said fixing member and notched friction roller relative to said rotatable shaft.

4. The paper feeding means of claim 3, comprising respective holes in said fixing portion and rotatable shaft; and an elongated member extending through said holes in said fixing portion and rotatable shaft to non-rotationally fix said fixing member to said rotatable shaft.

* * * * *

UNITED STATES PATENT AND TRADEMARK OFFICE

CERTIFICATE OF CORRECTION

PATENT NO. : 4,473,221

DATED : September 25, 1984

INVENTOR(S) : Tomio ARAI

It is certified that error appears in the above-identified patent and that said Letters Patent is hereby corrected as shown below:

Column 1, lines 19-27 should read as follows:

--The present invention relates to a paper feeding means comprising a rotatable shaft and at least one notched friction roller attached to said shaft for being brought into pressure contact with the upper surface of a pile of papers and forwarding the upper-most positioned paper, in which said notched friction roller is attached to said rotatable shaft so that said roller can be attached to and detached from the shaft by being moved in the radial direction.--

Column 1, line 52, change "making" to --moving--;

Column 1, lines 67-68, the words "surface. Thereof the" should read --surface thereof. The--;

Column 2, line 28, after "with the", change "axle, and shaft 5a" to --shaft 5. A--;

UNITED STATES PATENT AND TRADEMARK OFFICE

CERTIFICATE OF CORRECTION

PATENT NO. : 4,473,221 Page 2 of 2

DATED : September 25, 1984

INVENTOR(S) : Tomio ARAI

It is certified that error appears in the above-identified patent and that said Letters Patent is hereby corrected as shown below:

Column 2, line 33, after "roller 14", change "the shaft fixing" to -- . The shaft--;

Column 2, line 34, after "which", change "faces" to --bears--;

Column 2, line 40, after "the shape of", insert --a--;

Column 2, line 44, after "4f is", delete "forms";after "of", insert -- ⊃ --;

Column 2, line 49, after "4f", change ", and to" to --To--;

Column 2, line 54, after "portions of", the line should read --fixing members 4f and 4f'--;

Column 2, line 55, "ber 4f" should be deleted.

Signed and Sealed this

Eleventh Day of June 1985

[SEAL]

Attest:

DONALD J. QUIGG

Attesting Officer

Acting Commissioner of Patents and Trademarks